US011654527B2

(12) United States Patent
Shin

(10) Patent No.: US 11,654,527 B2
(45) Date of Patent: May 23, 2023

(54) POLISHING HEAD FOR USE IN CHEMICAL MECHANICAL POLISHING AND CMP APPARATUS HAVING THE SAME

(71) Applicant: XIA TAI XIN SEMICONDUCTOR (QING DAO) LTD., Qingdao (CN)

(72) Inventor: Jun-Sub Shin, Singapore (SG)

(73) Assignee: XIA TAI XIN SEMICONDUCTOR (QING DAO) LTD., Qingdao (CN)

( * ) Notice: Subject to any disclaimer, the term of this patent is extended or adjusted under 35 U.S.C. 154(b) by 523 days.

(21) Appl. No.: 16/788,098

(22) Filed: Feb. 11, 2020

(65) Prior Publication Data

US 2021/0154795 A1 May 27, 2021

(30) Foreign Application Priority Data

Nov. 22, 2019 (CN) ..... 201911152824.X

(51) Int. Cl.
*B24B 37/26* (2012.01)
*B24B 37/04* (2012.01)

(52) U.S. Cl.
CPC ..... *B24B 37/26* (2013.01); *B24B 37/042* (2013.01)

(58) Field of Classification Search
None
See application file for complete search history.

(56) References Cited

U.S. PATENT DOCUMENTS 6,110,012 A * 8/2000 Maury ..... B24B 57/02 451/36
6,336,846 B1 * 1/2002 Park ..... B24B 37/32 451/41

FOREIGN PATENT DOCUMENTS

KR 20030037064 A 5/2003

* cited by examiner

*Primary Examiner* — Long Pham
(74) *Attorney, Agent, or Firm* — ScienBiziP, P.C.

(57) ABSTRACT

The present disclosure is directed to a polishing head for polishing a wafer by a slurry. The polishing head includes a main body and at least two air modules. The main body has a cavity for accommodating the wafer, a main channel, and at least two sub-channels connected to the main channel. The at least two air modules are disposed at an outer surface of the main body. Each of the air modules is respectively connected to one of the sub-channels of the main body and configured to generate an air stream. When the polishing head rotates, the air stream forms an air curtain around the outer surface of the main body.

8 Claims, 7 Drawing Sheets

POLISHING HEAD FOR USE IN CHEMICAL MECHANICAL POLISHING AND CMP APPARATUS HAVING THE SAME

CROSS-REFERENCE TO RELATED APPLICATION

This application claims the benefit of and priority to a Chinese Patent Application No. 201911152824.X filed on Nov. 22, 2019, the entire content of which is incorporated by reference herein.

FIELD

The present disclosure generally relates to a polishing head for use in chemical mechanical polishing (CMP) and a CMP apparatus having the same. More specifically, the present disclosure relates to a polishing head for use in CMP having air modules to generate an air curtain around its outer surface to prevent slurry loss.

BACKGROUND

Chemical mechanical polishing or chemical mechanical planarization (CMP) is accomplished by holding the semiconductor wafer in a polishing head against a rotating polishing surface, or otherwise moving the wafer relative to the polishing surface, under controlled conditions of temperature, pressure, and chemical composition. The polishing surface, which may be a planar pad formed of a relatively soft and porous material such as a blown polyurethane, is wetted with a chemically reactive and abrasive aqueous slurry. The aqueous slurry, which may be either acidic or basic, typically includes abrasive particles, reactive chemical agent such as a transition metal chelated salt or an oxidizer, and adjuvants such as solvents, buffers, and passivating agents. Within the slurry, the salt or other agent provides the chemical etching action; whereas the abrasive particles and the polishing pad together provide the mechanical polishing action.

During the polishing process, the slurry is continuously supplied to the polishing pad by one or more nozzles. A large amount of the slurry is wasted as the wafer rotates or moves. Usually, only 25% of the slurry contribute to the polishing process, and 75% of the slurry is wasted.

Accordingly, there remains a need to provide a CMP apparatus that overcomes the aforementioned problems.

SUMMARY

In view of above, the present disclosure is directed to a polishing head for use in chemical mechanical polishing (CMP) and a CMP apparatus having the same to improve the use efficiency of slurries.

An implementation of the present disclosure is directed to a polishing head for polishing a wafer by a slurry. The polishing head includes a main body and at least two air modules. The main body has a cavity for accommodating the wafer, a main channel, and at least two sub-channels connected to the main channel. The at least two air modules are disposed at an outer surface of the main body. Each of the air modules is respectively connected to one of the sub-channels in the main body and configured to generate an air stream. When the polishing head rotates, the air stream forms an air curtain around the outer surface of the main body.

Another implementation of the present disclosure is directed to a chemical mechanical polishing (CMP) apparatus for polishing a wafer by a slurry. The CMP apparatus includes a platen, a slurry nozzle, and a polishing head. The platen has a polishing pad for polishing the wafer. The slurry nozzle is configured to spray the slurry onto the platen. The polishing is configured to hold the wafer and includes a main body and at least two air modules. The main body has a cavity for accommodating the wafer, a main channel, and at least two sub-channels connected to the main channel. The at least two air modules are with respect to the at least two sub-channels and disposed at an outer surface of the main body. Each of the air modules is respectively connected to one of the sub-channels in the main body and configured to generate an air stream. When the polishing head rotates, the air stream forms an air curtain around the outer surface of the main body.

Yet another implementation of the present disclosure is directed to a method of polishing a wafer. As shown in FIG. 5, the method includes actions S501 to S505. In action S501, the wafer is loaded to a chemical mechanical polishing (CMP) apparatus. The CMP apparatus has a polishing head and a platen. The polishing head of the CMP apparatus includes a main body and at least two air modules disposed at an outer surface of the main body. In action S502, an air stream is generated by each of the air modules. In action S503, the polishing head is rotated to form an air curtain by the air stream around the outer surface of the main body of the polishing head. In action S504, a slurry is sprayed to an area between the air curtain and the outer surface of the main body of the polishing head. In action S505, the wafer is polished by the slurry on the platen of the CMP apparatus.

As described above, the polishing head of the implementations of the present disclosure include at least two air modules disposed at an outer surface of the polishing head. Each of the at least two air modules is configured to generate an air stream. When polishing a wafer, the polishing head is rotated and the air stream forms an air curtain around a side surface of the polishing head. The air curtain formed by the air stream can retain the slurry in an area between the side surface of the polishing head and the air curtain to prevent slurry loss during rotation of the polishing head.

BRIEF DESCRIPTION OF THE DRAWINGS

Implementations of the present technology will now be described, by way of example only, with reference to the attached figures.

DETAILED DESCRIPTION

Figure 1:
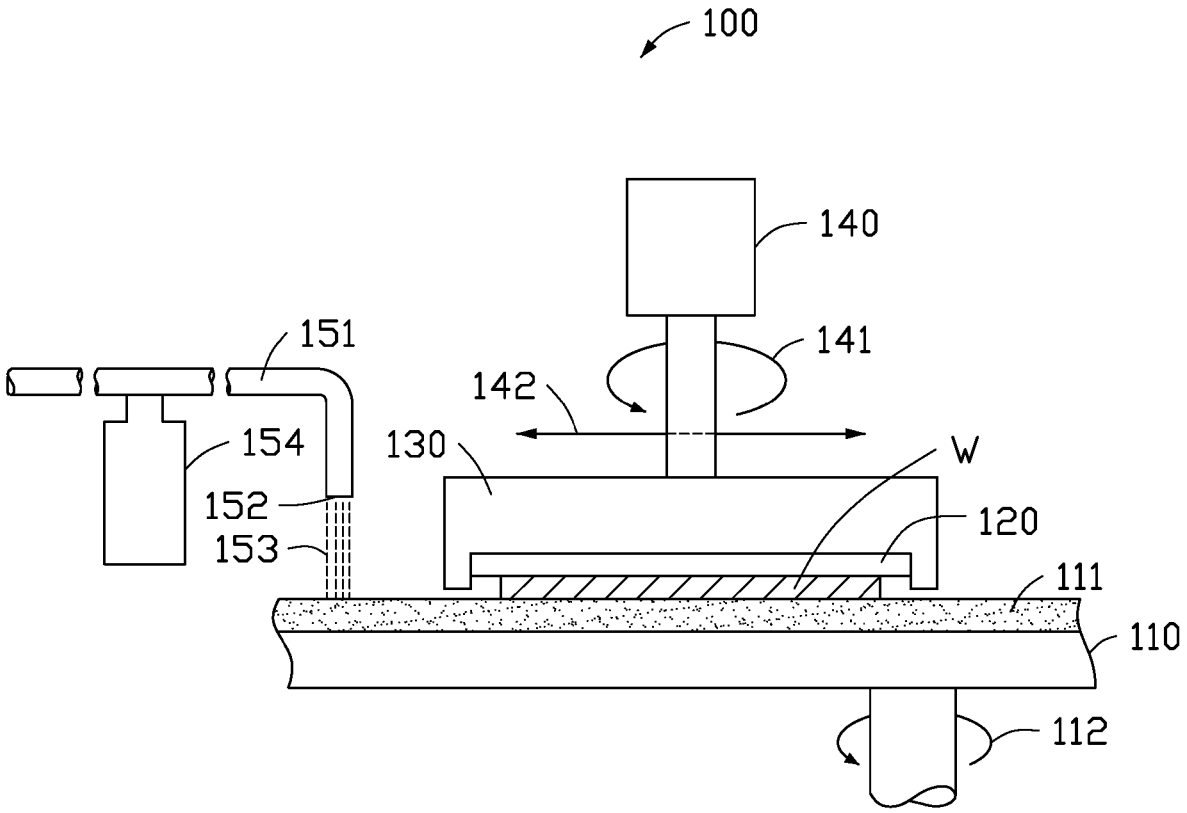
FIG. 1 is a schematic diagram of a CMP apparatus.

The present disclosure will now be described more fully hereinafter with reference to the accompanying drawings, in which example implementations of the disclosure are shown. This disclosure may, however, be implemented in many different forms and should not be construed as limited to the example implementations set forth herein. Rather, these example implementations are provided so that this disclosure will be thorough and complete, and will fully convey the scope of the disclosure to those skilled in the art. Like reference numerals refer to like elements throughout.

The terminology used herein is for the purpose of describing particular example implementations only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, actions, operations, elements, and/or components, but do not preclude the presence or addition of one or more other features, regions, integers, actions, operations, elements, components, and/or groups thereof.

It will be understood that the term "and/or" includes any and all combinations of one or more of the associated listed items. It will also be understood that, although the terms first, second, third etc. may be used herein to describe various elements, components, regions, parts and/or sections, these elements, components, regions, parts and/or sections should not be limited by these terms. These terms are only used to distinguish one element, component, region, part or section from another element, component, region, layer or section. Thus, a first element, component, region, part or section discussed below could be termed a second element, component, region, layer or section without departing from the teachings of the present disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the example implementations of the present disclosure in conjunction with the accompanying drawings in FIGS. 1 to 3B. Reference will be made to the drawing figures to describe the present disclosure in detail, wherein depicted elements are not necessarily shown to scale and wherein like or similar elements are designated by same or similar reference numeral through the several views and same or similar terminology.

The present disclosure will be further described hereafter in combination with the accompanying figures.

Referring to FIG. 1, a schematic diagram of a chemical mechanical polishing (CMP) apparatus is illustrated. The CMP apparatus 100 includes a polishing head 130 for polishing a semiconductor wafer W by a slurry 153. A soft pad 120 is positioned between the polishing head 130 and the wafer W, with the wafer W being held against the soft pad by a partial vacuum or with an adhesive. The polishing head 130 is provided to be continuously rotated by a drive motor 140, in a direction 141, and optionally reciprocated transversely in directions 142. Accordingly, the combined rotational and transverse movements of the wafer W are intended to reduce the variability in the material removal rate across the surface of the wafer W. The CMP apparatus 100 further includes a platen 110, which is rotatable in a direction 112. A polishing pad 111 is mounted on the platen 110. As compared to the wafer W, the platen 110 is provided with a relatively large surface area to accommodate the translational movement of the wafer W on the polishing head 130 across the surface of the polishing pad 111. A supply tube 151 is mounted above the platen 110 to deliver a stream of polishing slurry 153, which is dripped onto the surface of the polishing pad 111 from a slurry nozzle 152 of the supply tube 151. The slurry 153 may be gravity fed from a tank or reservoir (not shown), or otherwise pumped through the supply tube 151. Alternatively, the slurry 153 may be supplied from below the platen 110 such that it flows upwardly through the underside of the polishing pad 111. If the particles in the slurry 153 forms agglomeration of undesirable large particles, the wafer surface would be scratched when the wafer W is being polished. Therefore, the slurry 153 needs to be filtered to remove undesirable large particles. Usually, a filter assembly 154 is coupled to the supply tube 151 to separate agglomerated or oversized particles.

Figure 2A:
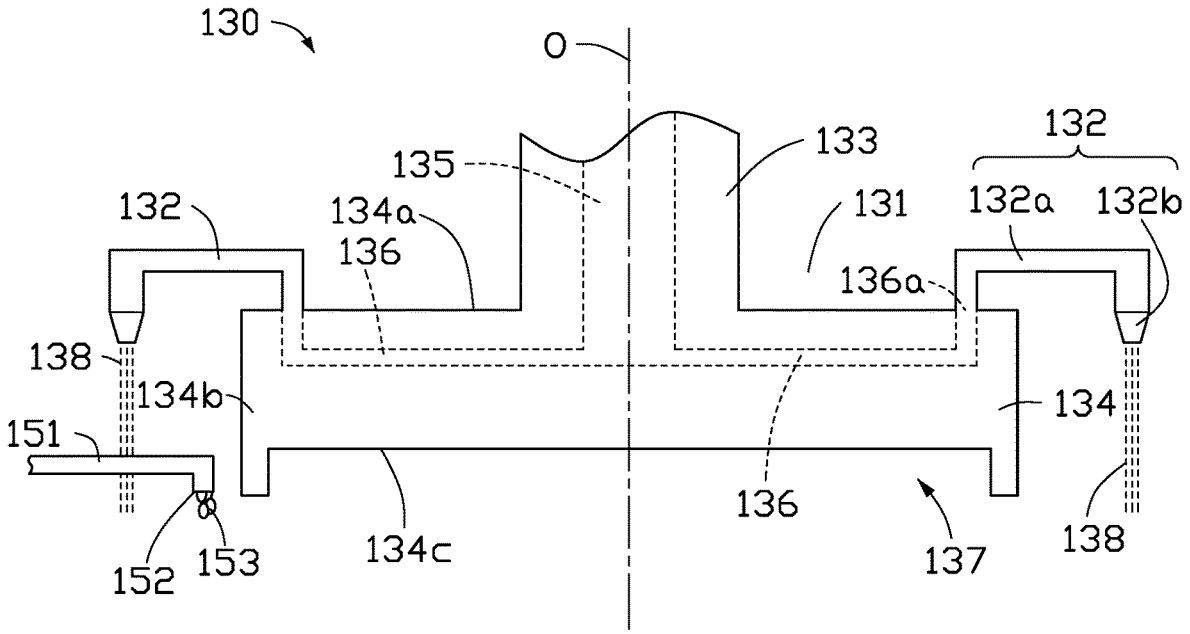
FIG. 2A is a side view of a polishing head of the CMP apparatus of FIG. 1 according to an implementation of the present disclosure.
Figure 2B:
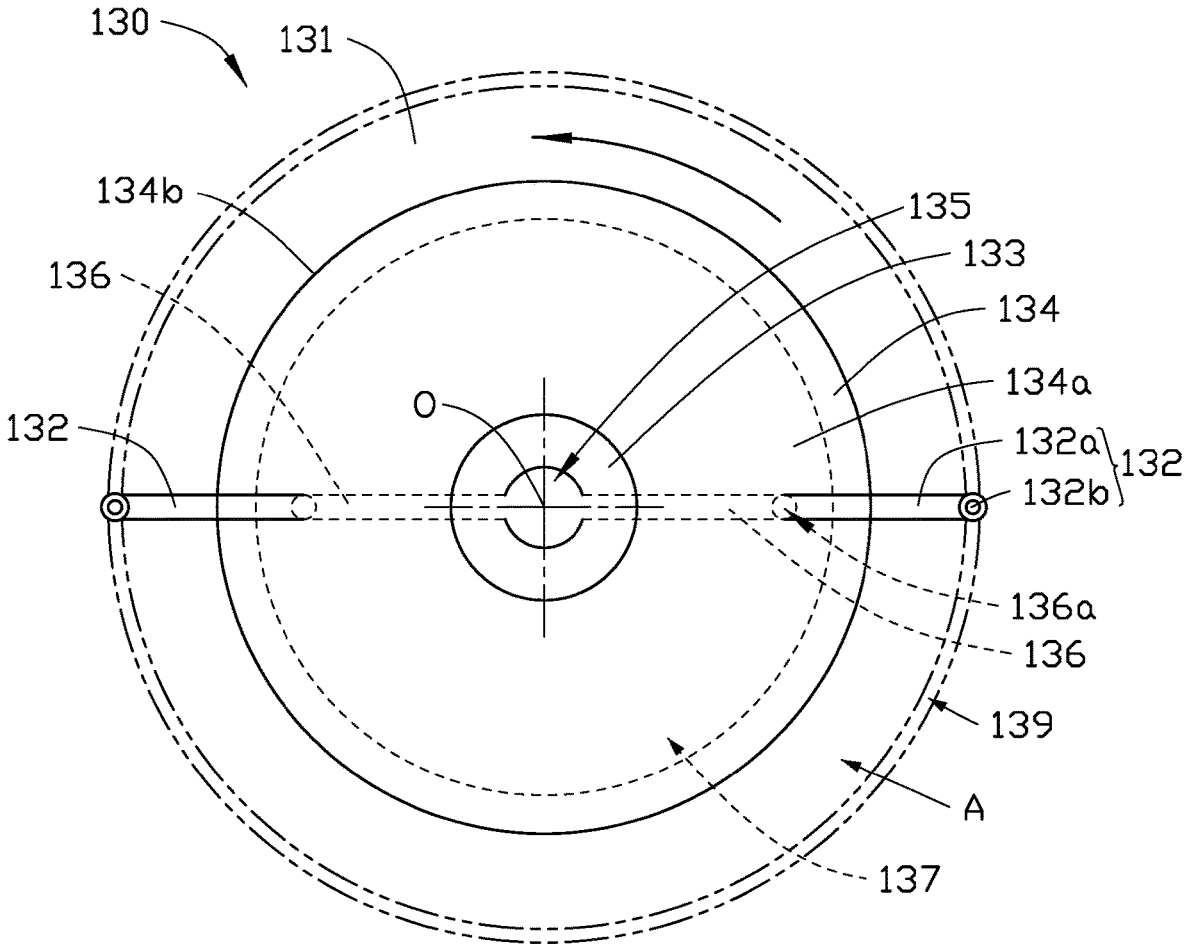
FIG. 2B is a top view of the polishing head of FIG. 2A.
Figure 2C:
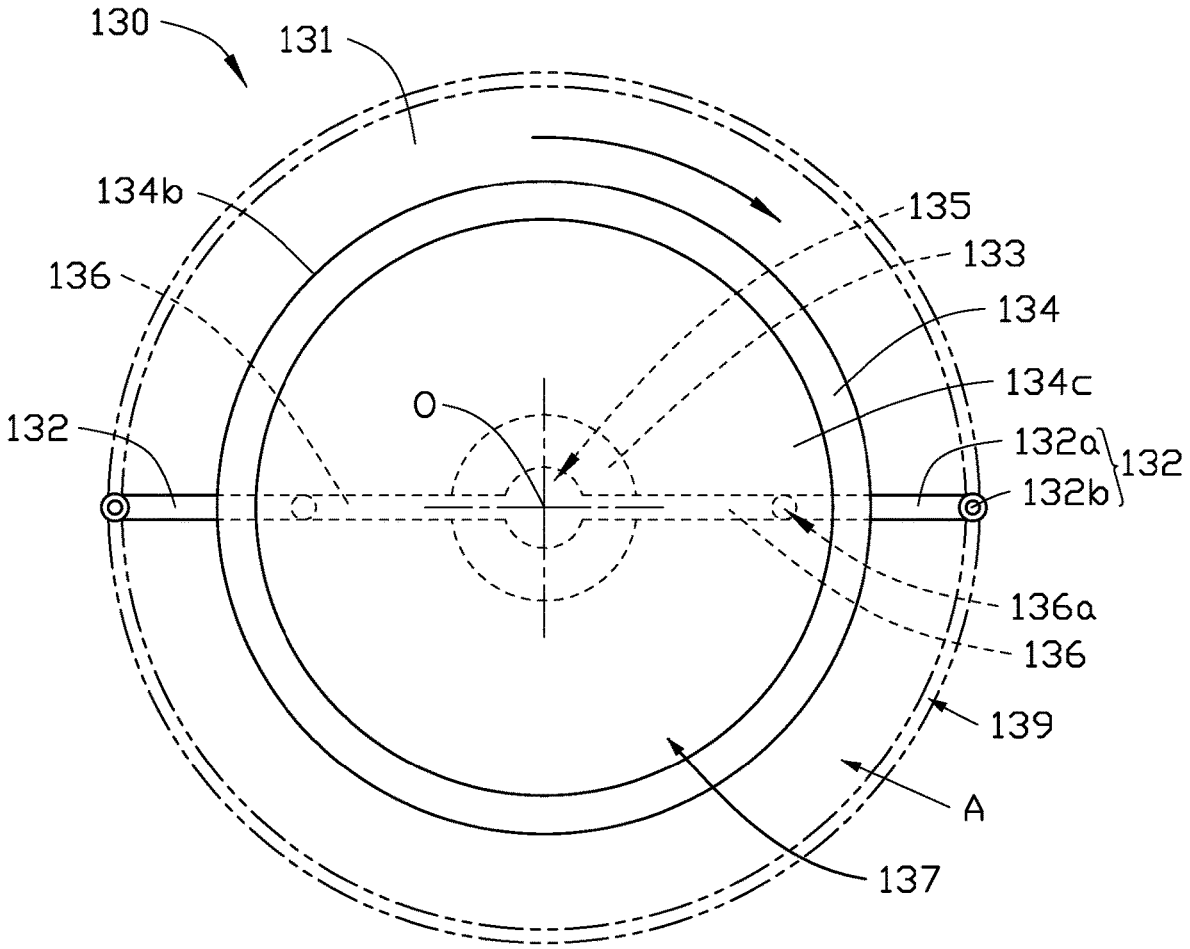
FIG. 2C is a bottom view of the polishing head of FIG. 2A.

Referring to FIGS. 2A to 2C, a side view, a top view, and a bottom view of the polishing head 130 of the CMP apparatus 100 of FIG. 1 according to an implementation of the present disclosure are illustrated. As shown in FIG. 2A to 2C, the polishing head 130 includes a main body 131 and at least two air modules 132. The main body 131 has a cavity 137 for accommodating the wafer W, a main channel 135, and at least two sub-channels 136 connected to the main channel 135. The at least two air modules 132 are disposed at an outer surface of the main body 131. In this implementation, the polishing head 130 has two air modules 132 disposed correspondingly to two sub-channels 136 of the main body 131. Each of the air modules 132 is respectively connected to one of the respective sub-channels 136 in the main body 131 and configured to generate an air stream 138. As shown in FIGS. 2B and 2C, when the polishing head 130 rotates, the air stream 138 forms an air curtain 139 around the outer surface of the main body 131.

The main body 131 has a rotation axis O. The air modules 132 are spaced at substantially equal angular intervals around the rotation axis O of the main body 131. As shown in FIGS. 2B and 2C, the two air modules 132 may be spaced at 180 degree angular intervals around the rotation axis O of the main body 131. The main body 131 includes an axial portion 133 and a base portion 134 connected to the axial portion 133. The base portion 134 has an upper surface 134*a*, a side surface 134*b*, and a bottom surface 134*c*. The cavity 137 of the main body 131 is disposed at the bottom surface 134*c* of the base portion 134. The main channel 135 is disposed at the axial portion 133 of the main body 131, and the sub-channels 136 are disposed at the base portion 134 of the main body 131. Each of the air modules 132 includes an air tube 132*a* and an air nozzle 132*b* connected to the air tube 132*a*. The air stream 138 is released downwardly from the air nozzle 132*b* of each of the air modules 132. In this implementation, each of the sub-channels 136 has an opening 136*a* disposed at the side surface 134*b* of the base portion 134 of the main body 131. The air tube 132*a* of each of the air modules 132 is connected to the opening 136*a* of each of the sub-channels 136. The air stream 138 generated by the air modules 132 flows in a direction parallel to the side surface 134*b* of the base portion 134 of the main body 131. The air curtain 139 formed by the air stream 138 surrounds the side surface 134*b* of the base portion 134. The air curtain 139 retains the slurry 153 in an area A between the side surface 134*b* of the base portion 134 of the main body 131 and the air curtain 139.

When polishing the wafer W, the slurry 153 is sprayed by the slurry nozzle 152 to the area A between the side surface 134*b* of the base portion 134 of the main body 131 and the air curtain 139. An air flow is supplied from the main channel 135 and then distributed into each sub-channel 136. The air flow is released or ejected downwardly from the each of the air nozzle 132*b* to form the air stream 138. When polishing the wafer W by the slurry 153 on the polishing pad 111, the polishing head 130 is usually rotated at a rotation rate higher than 100 revolutions per minute (rpm). The air stream 138 generated by each of the air modules 132 forms the air curtain 139 around the side surface 134*b* of the base portion 134 of the main body 131. Therefore, the slurry sprayed in the air curtain 139 is retained in the area A between the air curtain 139 and the side surface 134*b* of the polishing head 130. Accordingly, slurry loss during rotation of the polishing head 130 can be greatly reduced.

Figure 3:
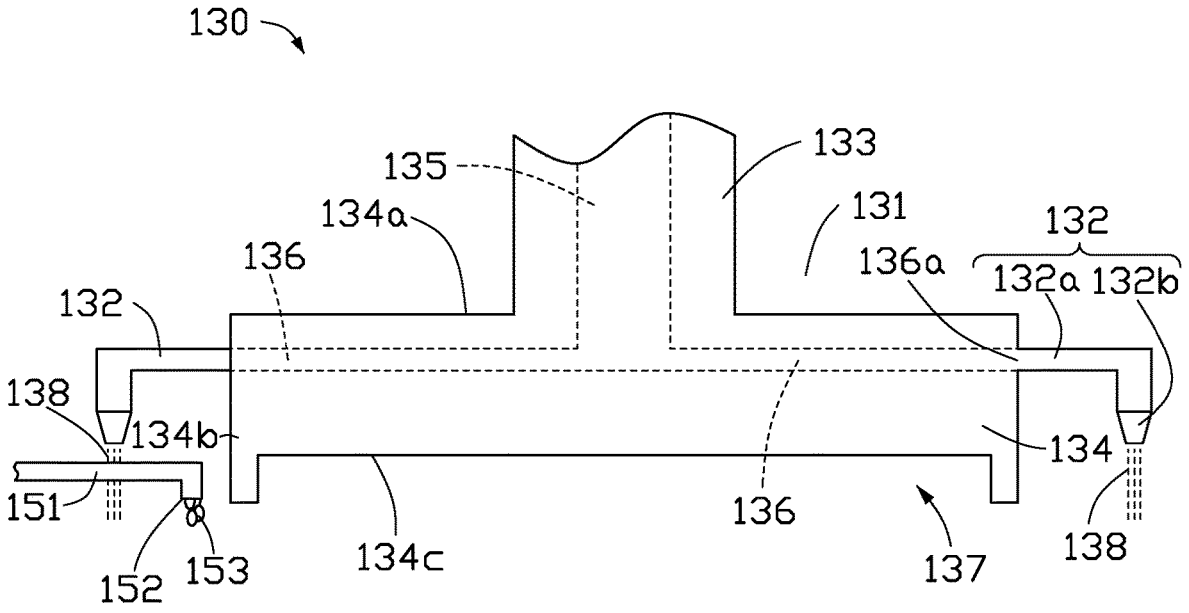
FIG. 3 is a side view of a polishing head of the CMP apparatus of FIG. 1 according to another implementation of the present disclosure.
Figure 4:
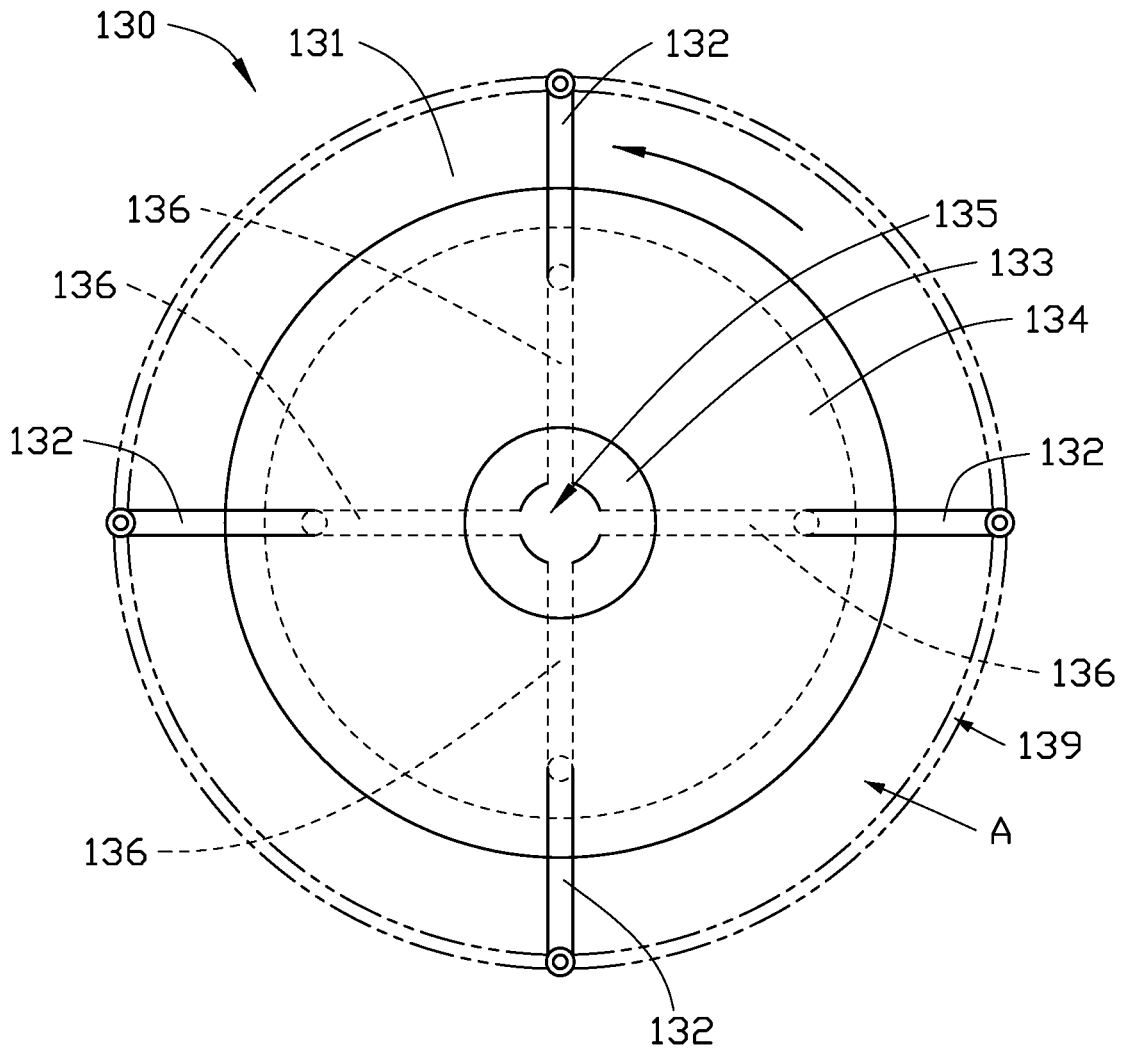
FIG. 4 is a top view of a polishing head of the CMP apparatus of FIG. 1 according to another implementation of the present disclosure.

Referring to FIGS. 3 and 4, various implementations of the polishing head 130 of the CMP apparatus 100 are illustrated. FIG. 3 is a side view of the polishing head 130 according to another implementation of the present disclosure. FIG. 4 is a top view of the polishing head 130 according to yet another implementation of the present disclosure. The polishing head 130 of FIGS. 3 and 4 is similar to the polishing head 130 of FIGS. 2A to 2C. In FIG. 3, each of the sub-channels 136 has an opening 136*a* at the upper surface 134*a* of the base portion 134 of the main body 131, and the air tube 132*a* of each of the air modules 132 is connected to the opening 136*a* of each of the sub-channels 136. In FIG. 4, the polishing head 130 includes four air modules 132 disposed at the outer surface of the main body 131. The four air modules 132 are spaced at 90 degree angular intervals around the rotation axis O of the main body 131. In other implementations, the polishing head 130 may have more air modules than the previous implementations. The details of other components of the polishing head 130 of FIGS. 3 and 4 can be referred to previous implementations for brevity.

According to another implementation, the present disclosure provides a chemical mechanical polishing (CMP) apparatus for polishing a wafer by a slurry. The CMP apparatus of this implementation can be referred to the CMP apparatus 100 of FIG. 1. As shown in FIG. 1, the CMP apparatus 100 includes a platen 110 having a polishing pad 111 for polishing the wafer W, a slurry nozzle 152, and a polishing head 130 for holding the wafer W. The slurry nozzle 152 is configured to spray the slurry 153 onto the platen 110. The polishing head 130 can be referred to FIGS. 2A to 4. The polishing head 130 includes a main body 131 and at least two air modules 132. The main body 131 has a cavity 137 for accommodating the wafer W, a main channel 135, and at least two sub-channels 136 connected to the main channel 135. The at least two air modules 132 are disposed at an outer surface of the main body 131. Each of the air modules 132 is respectively connected to one of the sub-channels 136 in the main body 131 and configured to generate an air stream 138. When the polishing head 130 rotates, the air stream 138 forms an air curtain 139 around the outer surface of the main body 131. The CMP apparatus 100 further includes a drive motor 140 connected to the polishing head 130 to rotate the polishing head 130 in the direction 141, and optionally reciprocated transversely in the directions 142. The CMP apparatus 100 may also further includes a supply tube 151 configured to supply the slurry 153 from the slurry nozzle 152. The details of other components of the CMP apparatus 100 and the polishing head 130 can be referred to the previous implementations. As described above, the polishing head 130 of the CMP apparatus 100 includes at least two air modules 132 disposed at the outer surface of the polishing head 130. Each of the at least two air modules 132 is configured to generate an air stream 138. When polishing the wafer W, the polishing head 130 is rotated and the air stream 138 forms an air curtain 139 around a side surface 134*b* of the polishing head 130. The air curtain 139 can retain the slurry in an area between the side surface 134*b* of the polishing head 130 and the air curtain 139 to prevent slurry loss during rotation of the polishing head 130.

Figure 5:
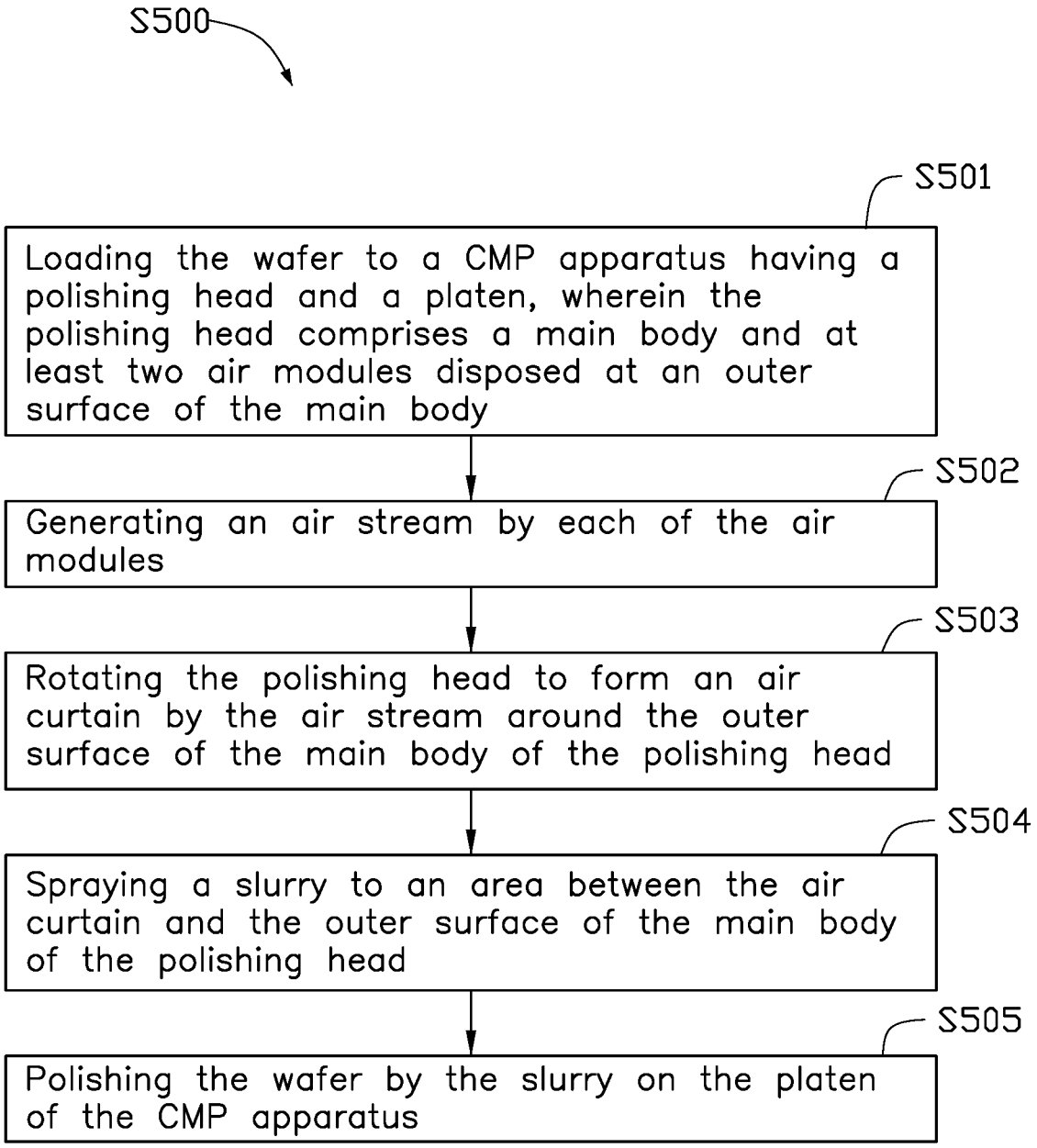
FIG. 5 is a flowchart of a method of polishing a wafer according to yet another implementation of the present disclosure.

Referring to FIG. 5, a flowchart of a method of polishing a wafer according to yet another implementation of the present disclosure is illustrated. As shown in FIG. 5, the method S500 includes actions S501 to S506. In action S501, the wafer is loaded to a chemical mechanical polishing (CMP) apparatus having a polishing head and a platen. The polishing head includes a main body and at least two air modules disposed at an outer surface of the main body. The CMP apparatus and the polishing head of the CMP apparatus can be referred to the CMP apparatus 100 and the polishing head 130 of FIGS. 1 to 4. The CMP apparatus 100 includes the platen 110 having a polishing pad 111 for polishing the wafer W, a slurry nozzle 152, and the polishing head 130 for holding the wafer W. The polishing head 130 includes a main body 131 and at least two air modules 132. The main body 131 has a cavity 137 for accommodating the wafer W, a main channel 135, and at least two sub-channels 136 connected to the main channel 135. The at least two air modules 132 are disposed at an outer surface of the main body 131.

In action S502, an air stream 138 is generated by each of the air modules 132 of the polishing head. The main body 131 has a rotation axis O. The air modules 132 are spaced at substantially equal angular intervals around the rotation axis O of the main body 131. The main body 131 includes an axial portion 133 and a base portion 134 connected to the axial portion 133. The base portion 134 has an upper surface 134*a*, a side surface 134*b*, and a bottom surface 134*c*. The cavity 137 of the main body 131 is disposed at the bottom surface 134*c* of the base portion 134. The main channel 135 is disposed at the axial portion 133 of the main body 131, and the sub-channels 136 are disposed at the base portion 134 of the main body 131. Each of the air modules 132 includes an air tube 132*a* and an air nozzle 132*b* connected to the air tube 132*a*. An air flow is supplied from the main channel 135 and then distributed into each sub-channel 136. The air flow is released or ejected downwardly from the each of the air nozzles 132*b* to form the air stream 138. The air stream 138 is released or ejected downwardly from the air nozzle 132*b* of each of the air modules 132.

In action S503, the polishing head 130 is rotated to form an air curtain 139 by the air stream 138 around the outer surface of the main body 131 of the polishing head 130. In action S504, a slurry 153 is sprayed to an area A between the air curtain 139 and the outer surface of the main body 131 of the polishing head 130. The slurry 153 is sprayed by the slurry nozzle 152 from a supply tube 151. In action S505, the wafer W is polished by the slurry 153 on the platen 110 of the CMP apparatus 100. When polishing the wafer W by the slurry 153 on the polishing pad 111 of the platen 110, the polishing head 130 is usually rotated at a rotation rate higher than 100 revolutions per minute (rpm). The air stream 138 generated by each of the air modules 132 forms the air curtain 139 around the side surface 134*b* of the base portion 134 of the main body 131. The slurry 153 is sprayed by the slurry nozzle 152 to the area A between the side surface 134*b* of the base portion 134 of the main body 131 and the air curtain 139. Therefore, the slurry sprayed within the air curtain 139 is retained in the area A between the air curtain 139 and the side surface 134*b* of the polishing head 130. Accordingly, the slurry loss during rotation of the polishing head 130 can be greatly reduced.

As described above, the polishing head of the implementations of the present disclosure include at least two air modules disposed at an outer surface of the polishing head. Each of the at least two air modules is configured to generate an air stream. When polishing a wafer, the polishing head is rotated and the air stream forms an air curtain around a side surface of the polishing head. The air curtain formed by the air stream can retain the slurry in an area between the side surface of the polishing head and the air curtain to prevent slurry loss during rotation of the polishing head.

The implementations shown and described above are only examples. Many details are often found in the art such as the other features of a polishing head for use in chemical mechanical polishing and a chemical mechanical polishing (CMP) apparatus having the same. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the implementations described above may be modified within the scope of the claims.

What is claimed is:

1. A polishing head for polishing a wafer by a slurry, the polishing head comprising:

a main body having a cavity for accommodating the wafer, a main channel, and at least two sub-channels connected to the main channel; and at least two air modules disposed at an outer surface of the main body, wherein each of the air modules is respectively connected to one of the sub-channels in the main body and configured to generate an air stream, and when the polishing head rotates, the air stream forms an air curtain around the outer surface of the main body;

wherein each of the air modules comprises an air tube and an air nozzle connected to the air tube, and the air stream is released from the air nozzle of each of the air modules; and wherein each of the sub-channels has an opening disposed at an upper surface of the base portion of the main body, and the air tube of each of the air modules is connected to the opening of each of the sub-channels.

2. The polishing head of claim 1, wherein the air modules are spaced at substantially equal angular intervals around a rotation axis of the main body.

3. The polishing head of claim 1, wherein the main body comprises an axial portion and a base portion connected to the base portion, and the cavity is disposed at a bottom surface of the base portion.

4. The polishing head of claim 3, wherein the main channel is disposed at the axial portion of the main body, and the sub-channels are disposed at the base portion of the main body.

5. The polishing head of claim 1, wherein each of the sub-channels has an opening disposed at a side surface of the base portion of the main body, and the air tube of each of the air modules is connected to the opening of each of the sub-channels.

6. The polishing head of claim 3, wherein the air stream generated by the air modules flows in a direction parallel to a side surface of the base portion of the main body.

7. The polishing head of claim 3, wherein the air curtain formed by the air stream surrounds a side surface of the base portion.

8. The polishing head of claim 7, wherein the air curtain retains the slurry in an area between the side surface of the base portion of the main body and the air curtain.

* * * * *